United States Patent [19]

Underwood et al.

[11] 4,173,049

[45] Nov. 6, 1979

[54] FLOTATION LINER WATERBED STRUCTURE

[76] Inventors: Ronald G. Underwood, 1415 W. North St., Anaheim, Calif. 92801; James C. Hauser, 26621 Westvale Rd., Palos Verdes, Calif. 90274

[21] Appl. No.: 864,466

[22] Filed: Dec. 27, 1977

[51] Int. Cl.[2] ..... A47C 27/08

[52] U.S. Cl. ..... 5/451; 5/473

[58] Field of Search ..... 5/368–371, 5/349, 350

[56] References Cited

U.S. PATENT DOCUMENTS

| | | | |
|---|---|---|---|
| 3,736,604 | 6/1973 | Carson, Sr. | 5/370 |
| 4,057,862 | 11/1977 | LaBianco | 5/370 |
| 4,062,077 | 12/1977 | Autrey et al. | 5/370 |
| 4,068,335 | 1/1978 | Phillips | 5/365 |

*Primary Examiner*—Casmir A. Nunberg

*Attorney, Agent, or Firm*—Mahoney, Schick & Cislo

[57] ABSTRACT

A safety liner for retaining liquids in a confined volume wherein liquid impervious side and bottom walls are positionable into the liquid retaining position by reason of flotation means or buoyant portions maintaining the side walls in the liquid confining relationship to prevent liquid spills and runoffs. An exemplary use of the safety liner is as a safety flotation liner for use in waterbed structures wherein inadvertent rupture of the water mattress will prevent water spills by reason of use of the flotation liner, which will permit emptying of the escaped water in a safe and efficacious manner without damage to the surroundings.

19 Claims, 11 Drawing Figures

FLOTATION LINER WATERBED STRUCTURE

BACKGROUND OF THE INVENTION

In various environments and circumstances, it is frequently necessary to confine liquids and other fluid substances in areas where contiguous articles and the like are liable to be damaged should rupture or escape of the liquid or flowable substances result. For example, in the increasing popular waterbed structure the waterbeds are placed in bedrooms and the like of residences wherein wood floors, carpets, furniture and the like articles are adjacently positioned such that should the water mattress rupture for one reason or another, the escaping water can do considerable damage not only to carpets, furniture and the like, but structurally to the residence wherein the waterbed mattress is housed.

In the ordinary case provision has been made to prevent water leakage onto bedroom floors and the like by the means of a liner which is positioned between the waterbed frame structure and the water mattress. The liner is usually a plastic sheet of sufficient thickness to be structurally conformable within the waterbed frame so as to retain escaped water therein. However, in some instances, the liner is merely positioned or placed within the frame or is not properly installed and made stationary by means of nails, tacks or the like, for fear of providing a sharp surface that could rupture the water mattress. Thusly, leakage of a sufficient amount of water from the ruptured or leaking water mattress will cause the liner to collapse about the perimeter of the frame, thereby allowing water to escape to damage the ambient surroundings.

With the herein described invention, a flotation safety liner is provided that, upon leakage of any amount of water, will not permit leakage to the ambient surroundings. The safety flotation liner comprises bottom and side walls wherein the material of construction makes same impervious to liquids and forms an impervious liquid boundary interface and wherein the sidewall panels terminate in outwardly spaced buoyant portions adapted to maintain and retain the sidewall portions in such a manner that any escaped liquid will not flow over the sidewalls, but will be retained within the bed frame structure.

Obviously, the attributes of the invention may be used in environments other than a waterbed one where it is desirable to retain liquids or other flowable substances in a safe, efficient and economical manner.

OBJECTS AND SUMMARY OF THE INVENTION

It is an object of the invention to provide a safety liner for retaining liquids and flowable substances in a confined volume. It is another important object of the invention to provide a safety liner and flotation member for utilization in confining bodies of liquids or flowable substances.

It is another important, more specific, object of the invention to provide a safety liner and flotation means for utilization in waterbed structures for confining escaped liquid from the water mattress so that the escaped liquid will not cause damage to the surrounding premises.

It is another, still more specific, object of the invention to provide a safety flotation liner for utilization with waterbeds wherein the liner has fluid impervious bottom and side walls, the side walls having inner connected buoyant portions that will maintain the side walls in erected relationship for confining liquids within the confined volume defined by the boundary of said side and bottom walls.

It is still another, more specific important object of the invention to provide a plastic flotation safety liner for waterbed structures wherein the liner employs buoyant portions adapted to maintain the side walls in a liquid encompassing and confining position.

Generally, in an exemplary embodiment, the invention is directed to a safety liner for retaining liquids in a confined volume comprising the combination of bottom and side wall panels forming an impervious liquid boundary interface. The side wall panels opposite the bottom wall terminate in outwardly spaced buoyant portions adapted to maintain said side walls in a liquid encompassing and confining position. In another embodiment, the safety liner is used in conjunction with a waterbed structure and the buoyant portions may be provided by a hollow extension or addendum of the side wall wherein a substance having a specific gravity less than one is confined therein so as to buoyantly support the side walls of said liner.

These and other objects will become apparent from the hereinafter following commentary taken in conjunction with the drawings.

DESCRIPTION OF THE BEST EMBODIMENTS CONTEMPLATED

Referring to the figures of drawings wherein like numerals of reference designate like elements throughout, the invention will be described as it specifically relates to its use in a waterbed structure or combination. It should be understood that the invention of a safety flotation liner has greater application than that which will be specifically described. In other words, wherever it is desired to confine a body of liquid or flowable substances, the invention will have applicability with or without modification. Those of ordinary skill in the art will at once recognize that the essence and spirit of the invention will have a wide application of uses and need not be restricted to its use in a waterbed structure.

Figure 1:
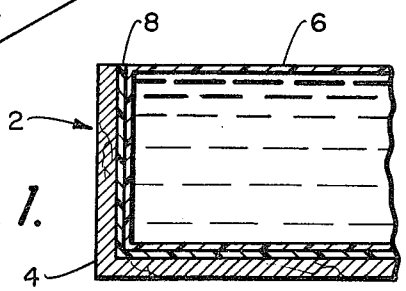
FIG. 1 is a fragmented, side-elevational view of the prior art type of waterbed structure.

For purpose of illustration only, there is illustrated a waterbed structure 2, comprising the prior art form having the usual frame or pedestal 4, water mattress 6 retained within the frame 4, and having intermediate, waterproof liner 8 disposed so as to assertedly retain escaped water from mattress 6 to thereby prevent damage to the surroundings. (See FIG. 1.)

In the described prior art waterbed structure 2, rupture of any of the seams from the mattress 6 will cause loss of fluid and consequently collapse of the side or of liner 8 so that water will be permitted to escape from within the structure 2, to cause damage to the surrounding area. However, in the practice of the present invention, a safety liner 10 is used with or without the usual liner 8 just described, wherein the liner 10 comprises bottom wall 12 and side walls 14 and 16, the side walls terminating in extending buoyant wall portions 18 and 20.

Figure 3:
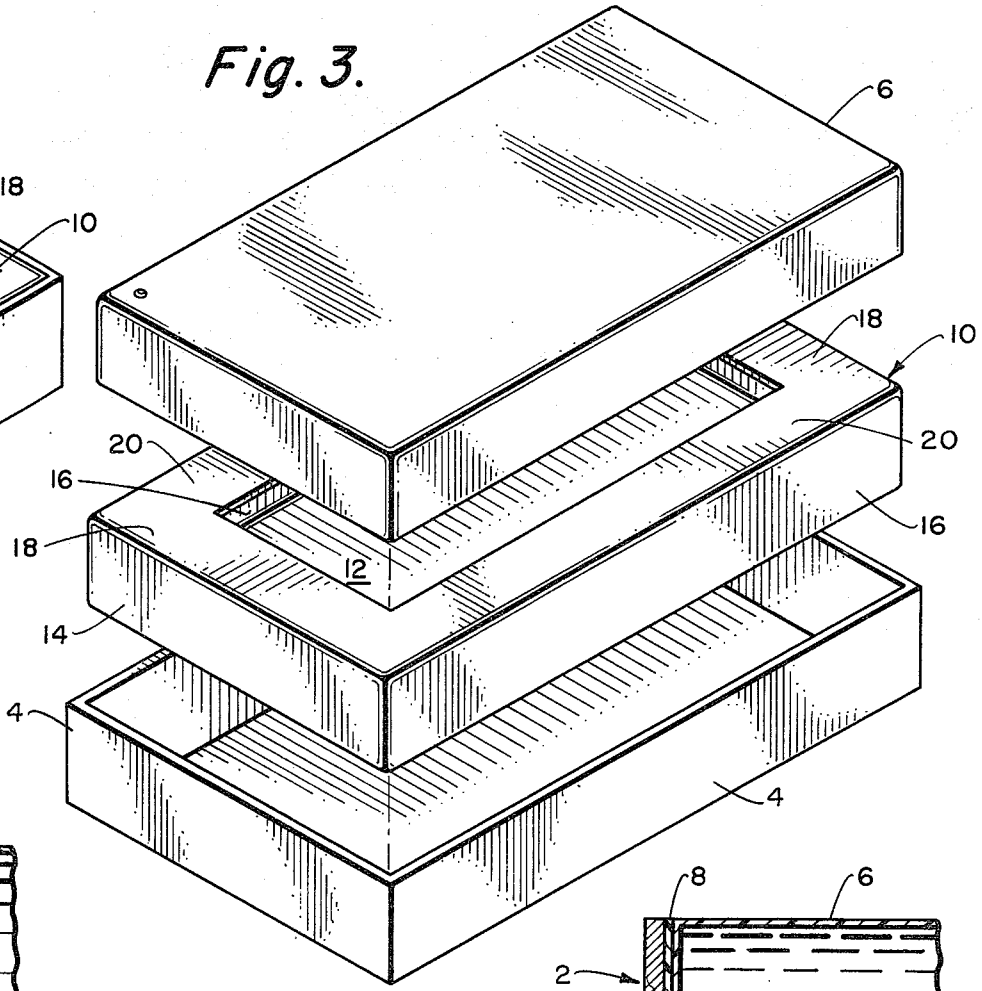
FIG. 3 is an exploded view of a waterbed structure as shown in FIG. 2, employing one form of the flotation liner of the invention.
Figure 2:
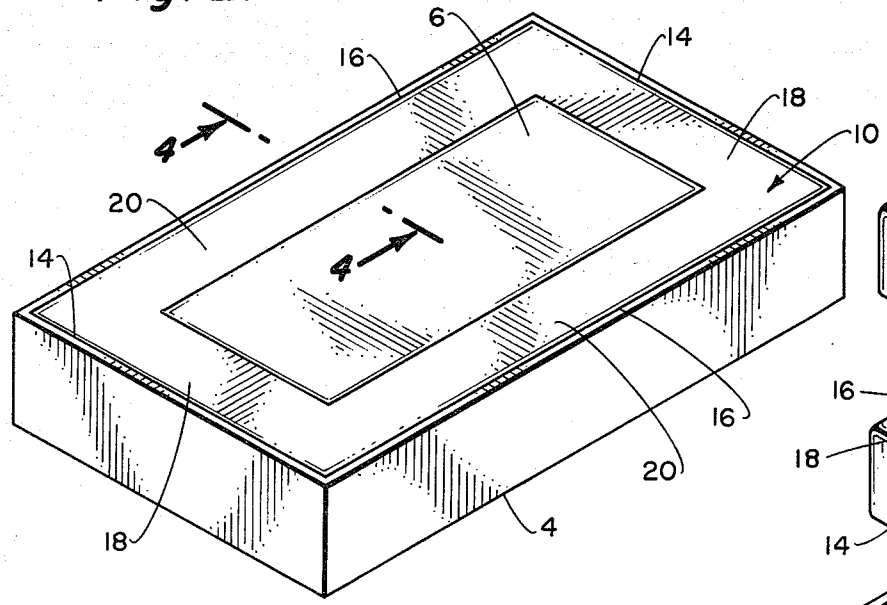
FIG. 2 is a perspective view of one form and use of the safety liner of the invention in conjunction with a waterbed structure.

Referring to FIG. 3, and merely for purposes of illustration, in order to use the flotation liner 10 of the invention, the frame structure 4 would be provided, the liner 10 positioned within the frame 4, and the unfilled water mattress 6 inserted interiorly of the liner 10 so that upon filling of the water mattress 6 the water mattress would be within the confines of flotation liner 10 and have wall portions 20 and 18 super-posed thereover, as illustrated in FIG. 2.

Flotation or safety liner 10 is made of plastic material, for example, polyvinyl chloride and the like, and has a thickness of about 8 mils., or an approved equivalent, and may even be greater where cost is not a factor and may range up to 20 mils. in thickness, for example. However, the usual thickness of polyvinyl chloride used in practice of the invention, will be about the same weight and type utilized in the manufacture of water mattresses themselves.

Figure 4:
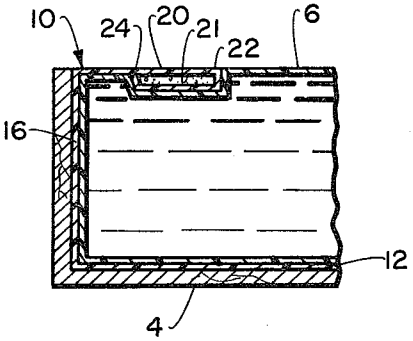
FIG. 4 is a fragmented view, in cross-section, taken along the line 4—4 of FIG. 2.

Referring to FIG. 4, one form of the safety liner 10 is illustrated, wherein the bottom wall 12 is integrally formed with side wall 16, the upper portion of side wall 16 terminating in an outwardly spaced (from said side wall 16) buoyant portion 20. Obviously the buoyant portion 18 is similarly constructed and the buoyant portions 18 and 20 are contiguous, continuous and are positioned about the perimeter of the side walls 14 and 16 of safety liner 10.

Referring to the FIG. 4 embodiment, it will be noted that the side wall 16 terminates in a spaced portion 22 extending a sufficient distance to form, in this instance, an integral buoyant portion 20 formed by a doubling-back of the vinyl plastic and heat-sealing thereof at the juncture 24, thereby forming a hollow or space 21. The space 21 is actually a flotation chamber and may have disposed, therein, air or other gas which would make the side walls buoyantly supported or alternately may contain polyurethane foam, sponge-like in physical characteristics and being cellular in form, so as to have a great many air spaces to thereby make the buoyant portion 20 buoyant. The flotation space 21 may contain any material or substance so long as the specific gravity thereof is less than the liquid or flowable substance that it is desired to retain. Thus, where water is desired to be retained, the specific gravity of the material, fluid, gas or otherwise, should have a specific gravity less than 1 to insure buoyancy.

Additionally, the depth and width of buoyant portion 20, and more specifically, flotation chamber 21, should be such as to take into account the weight of the side walls of the liner to be supported and in the typical case, the width of the flotation liner, when used in conjunction with a waterbed mattress, may be between 3–6" and may have a depth of approximately ½–1½", and of course extends about the perimeter of the side walls 14 and 16, as illustrated in the drawings.

Referring to FIG. 4, it should be obvious that the mattress 6 containing water is confined within the liner 10 and should a leak develop, water will tend to leak out to the inter-face formed between the walls of the water mattress 6 and the interior side walls of the flotation liner 10. Because of the buoyant portions, and more particularly, flotation chamber 21, the side walls 14 and 16 will be retained in the vertical or supported position to thereby retain any escaped water and therefore prevent its escape onto surrounding areas to thereby prevent water damage.

Figure 5:
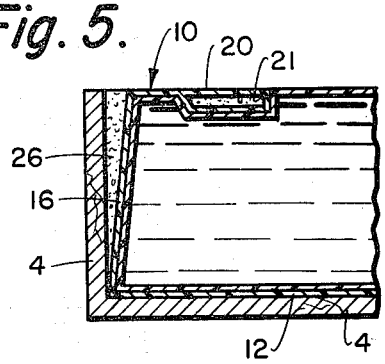
FIG. 5 is a fragmented, cross-sectional view similar to FIG. 4, but showing an alternate form of the invention.

Referring to FIG. 5, the identical structure, as heretofore described with respect to FIGS. 2, 3 and 4, is illustrated, with the exception that a styrofoam or polyurethane foam wedge portion 26 is positioned adjacent the side walls 14 and 16 so as to provide additional buoyant forces to these side walls and therefore to aid in the buoyant portions 20, retaining the side walls 14 and 16 in the fluid-retaining position. The wedge member 26 is positioned coextensive with the side walls 14 and 16 about the perimeter of the safety liner 10 and may also be adhered to the exterior walls 14 and 16 of safety liner 10 with plastic adhesives or other means of securement well known in the art so as to give additional support to side walls 14 and 16. The wedge members 26 also form a buffer between the interior surface of the frame member 4 to thereby prevent sharp surfaces coming into contact with the side walls 14 and 16 of liner 10.

Figure 6:
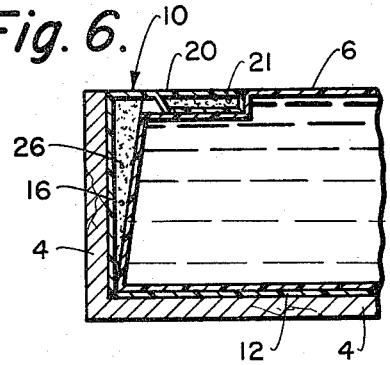
FIG. 6 is a view similar to FIG. 5 and illustrating still another form of the invention.
Figure 7:
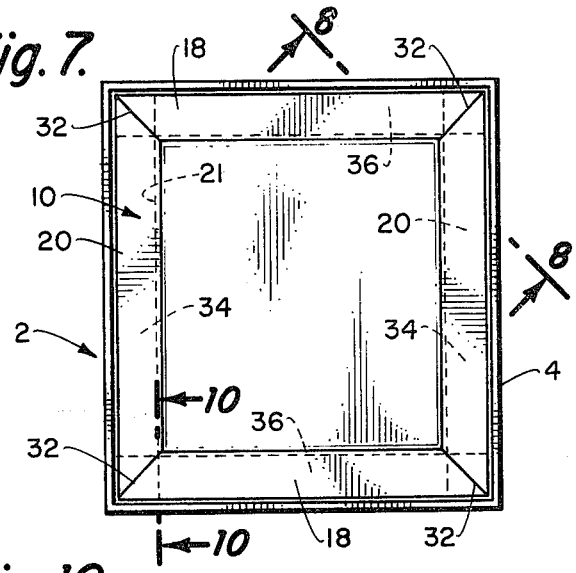
FIG. 7 is a plan view of the waterbed structure depicted in FIG. 2.

Referring to FIG. 6, another alternative embodiment of the liner is illustrated wherein the liner 10 has the buoyant wedge 26 positioned interiorly, as opposed to exteriorly, as illustrated in FIG. 5. Again, the buoyant wedge 26 is coextensive with the side walls 14 and 16 and may be adhesively secured to the interior walls by means of plastic adhesives or the like, or may be otherwise positioned by means of friction fit to provide the additional buoyant forces to keep the side walls 14 and 16 in the fluid retaining position, as illustrated in the figures of drawings.

Additionally, a pocket construction, not shown, may be built integrally with the side walls 14 and 16 so as to receive the buoyant wedge members 26, which members may be of conformable material, such as polyurethane foam, sponge-like in character, or may be slightly rigidified, such as styrofoam, depending upon the end results desired, just so long as sufficient buoyancy is obtained so as to support the side walls should fluid escape from the water mattress 6.

Referring to FIGS. 7–10, more details of construction of the water bed 2, of the form illustrated in FIGS. 2, 3 and 4, are illustrated. As can be seen, particularly with respect to FIG. 7, the buoyant portions 20 and 18 may be formed by heat-sealed segments or panels along juncture lines 32 to thereby form chamber 21 which houses, in this particular illustration, foam panels 34 and 36 shown in dotted line, and being over and underlapping with respect to each other at the areas defining juncture lines 32 so as to provide additional buoyancy for the corners of the liner 10.

Figure 10:
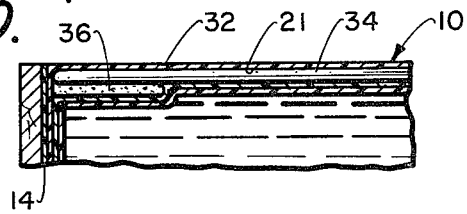
FIG. 10 is an enlarged, fragmented view taken along the line 10—10 of FIG. 7.
Figure 8:
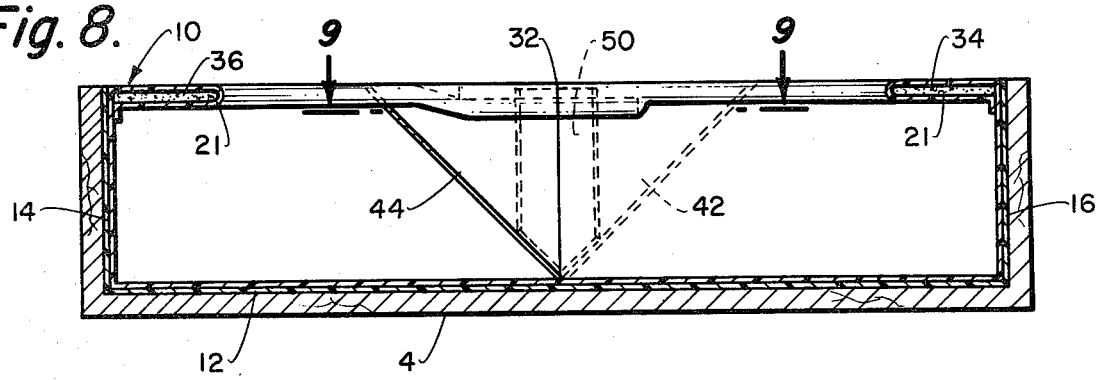
FIG. 8 is a view taken along the line 8—8 of FIG. 7.
Figure 9:
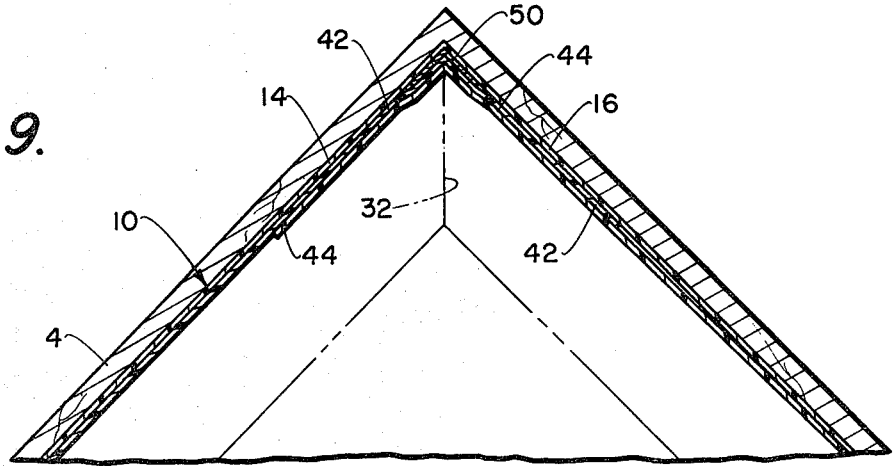
FIG. 9 is an enlarged, fragmented view taken along the line 9—9 of FIG. 8.

Referring now to FIGS. 8, 9 and 10, it will be noted that the safety or flotation liner 10, and in particular the side walls 16 and 14, are formed integrally with the bottom wall 12 and has the side wall panels 14 and 16 overlapping one another, as at 42 and 44, so as to provide reinforced corner sections to adequately retain escaped liquor or fluid within flotation or safety liner 10. In the FIGS. 8 and 9 illustration, the water mattress 6 is not shown for purposes of clarity.

As can be seen from FIGS. 8 and 9, there is provided in the corners of the structure a corner retainer or stiffener 50 which may be dependently positionable, in order to retain the integrity of the corner sections of flotation liner 10 or, alternately, pockets may be provided in the side walls adjacent to the corners, in the usual conventional fashion, in which the cardboard or plastic stiffeners 50 may be inserted.

Figure 11:
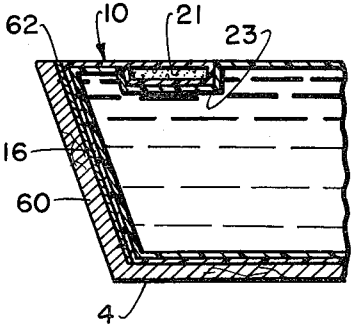
FIG. 11 is a view similar to FIGS. 4, 5 and 6, but illustrating a different type of support structure and another alternative form of the invention.

Referring now to FIG. 11, another alternative embodiment is illustrated wherein the frame structure 60 is depicted as having an inclined or slanted side wall to provide ease of access in the approach to the waterbed structure and wherein a liner 62 is provided adjacent the side walls 14 and 16 and is coextensive therewith so as to insulate and negate the possibility of burrs or splinters coming into contact with either the liner 10 or a person's hand when placing sheets (not shown) onto the water mattress of the waterbed structure 2.

When the buoyant sections are adapted to retain other than gaseous fluids, and in particular the foam material for buoyancy, as illustrated throughout the drawings, perforations (not shown) in the upper wall 23 may be provided so as to make the buoyant section more conformable so as not to entrap undue amounts of air to thereby cause the safety liner 10 to be bulky and difficult to fold for storage and/or transportation purposes. While, in some particulars, the safety and flotation liner 10 has been illustrated as being integrally formed, it is quite obvious that the buoyant portion 20, for example, and in particular the flotation chamber 21, may be formed with individual vinyl portions heat-sealed in a manner well-known in the arts to provide the desired end result.

While the invention has been described in specific relationship to waterbeds and waterbed structures, various changes and modifications will at once present themselves to those of ordinary skill in the arts and all such changes and modifications will not depart from the essence and spirit of the invention and all are intended to be included in the appended claims.

We claim:

1. A safety liner for retaining liquids in a confined volume comprising the combination: bottom and side wall panels forming an impervious liquid boundary interface, said side wall panels opposite said bottom wall terminating in outwardly, spaced buoyant portions adapted to maintain said side walls in a liquid encompassing and confining position, said buoyant portions being formed by spaced wall portions thereby defining an enclosed laterally extending, with respect to said bottom panel, hollow flotation chamber, the width and thickness of said buoyant portions being sufficient to provide buoyant forces for buoying up said side wall panels, said bottom, side wall panels and spaced wall portions being formed by heat-sealable plastic.

2. The safety liner, in accordance with claim 1, wherein said buoyant portions are air tight and said buoyant chamber is adapted to retain air or other gaseous fluid therein to thereby provide the buoyant force.

3. The safety liner, in accordance with claim 1, wherein said flotation chamber contains resilient, cellular, foam materials somewhat spongelike in character to thereby provide the said buoyant force.

4. The safety liner, in accordance with claim 1, wherein said cellular foam layer is in strip form and has a thickness substantially that of said flotation chamber.

5. The safety liner, in accordance with claim 7, wherein said strips of cellular foam material are overlapped at the corners of said liner to provide additional buoyancy therefor.

6. The safety liner, in accordance with claim 8, wherein said side walls are of individual panels overlapping at the corner intersections and additionally includes buoyant foam wedge members adjacently positioned said side walls in order to impart additional buoying forces thereto.

7. A waterbed structure comprising at least a combination of: a frame support; a water mattress and a safety liner intermediate said frame support and water mattress, said safety liner comprising conformable bottom and side walls, said side walls having outwardly spaced therefrom, connecting and continuous buoyant portions about the perimeter thereof whereby rupture of said water mattress, when filled with fluid, will cause said safety liner to retain escaped fluid by reason of said buoyant portions retaining the integrity of said side walls in a liquid-containing position.

8. The waterbed structure, in accordance with claim 7, wherein said frame inclines inwardly with respect to the surface of said water mattress.

9. The waterbed structure, in accordance with claim 7, wherein said buoyant portion is filled with a substance having a specific gravity less than 1.

10. The waterbed structure, in accordance with claim 7, wherein said buoyant portion is filled with a gaseous fluid, such as air.

11. The waterbed structure, in accordance with claim 1, including foam wedge members positioned adjacent and continuous with said side walls, in order to provide additional buoyancy to said safety liner.

12. The waterbed structure, in accordance with claim 11, including a layer member between said frame and safety liner to thereby insulate said safety liner from the frame surface against which said safety liner abutts.

13. The waterbed structure, in accordance with claim 12, wherein said side walls are of heat-sealable plastic and are overlapped at the corner seams thereof.

14. The waterbed structure, in accordance with claim 13, wherein said safety liner and buoyant portions are of heat-sealable plastic.

15. The waterbed structure, in accordance with claim 14, wherein said buoyant portions are hollow and the width and depth of said hollow portion is sufficient to provide a flotation chamber in order to provide buoyant forces to said safety liner.

16. The waterbed structure, in accordance with claim 15, wherein said wedge-shaped buoyant member is positioned adjacent to the interior side walls of said safety liner and is coextensive with said side walls.

17. The waterbed structure, in accordance with claim 16, wherein said buoyant portions are coextensive with the perimeter of said water mattress.

18. A safety liner for retaining liquids in a confined volume comprising the combination of: bottom and side wall panels forming an impervious liquid boundary interface, said side wall panels opposite said bottom wall terminating in outwardly spaced buoyant portions adapted to maintain said side walls in a liquid encompassing and confining position, said buoyant portions being formed by spaced wall portions thereby defining a hollow flotation chamber containing resilient, cellular, foam materials somewhat sponge-like in character, the width and thickness of said buoyant portions being sufficient to provide buoyant forces for buoying up said side wall panels, and wherein said bottom and side walls are of plastic and are heat-sealable and said buoyant portions are formed by a plastic wall layer being doubled over to form a hollow space to thereby define said flotation chamber and is heat-sealed to said wall.

19. A waterbed structure comprising at least a combination of: a frame support; a water mattress and a safety liner intermediate said frame support and water mattress, said safety liner comprising conformable bottom and side walls, said side walls having outwardly spaced therefrom, connecting and continuous buoyant portions about the perimeter thereof whereby rupture of said water mattress, when filled with fluid, will cause said safety liner to retain escaped fluid by reason of said buoyant portions retaining the integrity of said side walls in a liquid-containing position, said buoyant portion being filled with a substance having a specific gravity less than 1 and having cellular foam members substantially about the size of said buoyant portion having an over and underlap relationship at the corners thereof, in order to provide additional buoyancy.

* * * * *